United States Patent [19]

Kikuchi et al.

[11] Patent Number: 4,747,713

[45] Date of Patent: May 31, 1988

[54] INK RIBBON CASSETTE INCLUDING GEAR TEETH CONFIGURED TO RE-INK THE RIBBON

[75] Inventors: Hiroshi Kikuchi; Takashi Itaya, both of Tokyo; Masakuni Anada, Fukushima, all of Japan

[73] Assignee: Oki Electric Industry Co., Ltd., Tokyo, Japan

[21] Appl. No.: 877,965

[22] Filed: Jun. 24, 1986

[30] Foreign Application Priority Data

Jun. 27, 1985 [JP] Japan ..... 60-96748[U]

[51] Int. Cl.[4] ..... B41J 27/12

[52] U.S. Cl. ..... 400/202.4; 400/196.1; 400/235.1

[58] Field of Search ..... 400/119, 196.1, 197, 400/202.2, 202.3, 202.4, 235.1

[56] References Cited

U.S. PATENT DOCUMENTS 4,153,378 5/1979 Scherrer et al. ..... 400/196.1
4,213,716 7/1980 Carson, Jr. ..... 400/196.1
4,400,103 8/1983 Daughters ..... 400/235.1 X
4,428,695 1/1984 Jamieson ..... 400/235.1 X
4,526,488 7/1985 Krull ..... 400/202.4
4,552,469 11/1985 Tsuge et al. ..... 400/119
4,616,942 10/1986 Nagasawa et al. ..... 400/196.1
4,636,097 1/1987 Goubeaux ..... 400/196.1

FOREIGN PATENT DOCUMENTS 0131851 4/1984 Japan ..... 400/196.1

*Primary Examiner*—Ernest T. Wright, Jr.
*Attorney, Agent, or Firm*—Wenderoth, Lind & Ponack

[57] ABSTRACT

An ink ribbon cassette to be used in wire dot printer has an ink supply to lengthen a life cycle thereof. An ink ribbon is held between a drive gear and an idle gear and is delivered thereby. The ink supply contacts the idle gear so that ink is supplied from the idle gear to the ink ribbon. The teeth of the idle gear are specifically shaped such that the bottom of the teeth are formed in the shape of a circular arc so that the ink is uniformly supplied to the ink ribbon.

9 Claims, 3 Drawing Sheets

INK RIBBON CASSETTE INCLUDING GEAR TEETH CONFIGURED TO RE-INK THE RIBBON

BACKGROUND OF THE INVENTION

1. Field of the Invention:

This invention relates to an ink ribbon cassette for use with an impact printer, more particularly to such an ink ribbon cassette having teeth for feeding an ink ribbon mounted in the ink ribbon cassette.

2. Description of the Prior Art:

U.S. Pat. No. 4,552,469 discloses an ink dot printer having an ink cartridge and an ink tank. Magnetic ink is filled into the ink cartridge. A slit in the ink cartridge and a connecting hole communicate with each other. The magnetic ink flows from the ink cartridge. When a main switch is turned on, the magnetic ink is absorbed in a slit provided between front end portions to thereby define a magnetic ink film. When a tip end of a needle projects to the magnetic ink film, the magnetic ink is applied to the tip end and is supplied to a surface of a recording paper. Upon selectively driving the needle, characters and numerals are visibly formed on the surface of the recording paper. The ink supplied to the tip end of the needle thus is consumed. Magnetic ink is newly supplied from the ink tank to the tip end of the needle upon completion of the series of operations set forth above. U.S. Pat. No. 4,552,469 discloses a plurality of dot characters and numerals being printed in succession, but does not teach a concept of printing by the needle via the ink ribbon by transferring the ink to the ribbon. Such patent discloses that the ink film between the front end portions is directly delivered to the recording paper via the needle, but there is no description of extending the life cycle of the ink ribbon.

Another prior art arrangement is shown in Japanese utility model Ser. No. 58-25727 filed Feb. 25, 1983 (laid-open publication No. 59-131851) in the name of Yoshinori Koshida and Kenji Kanabo for an invention entitled RIBBON CARTRIDGE. Koshida et al disclose a ribbon cartridge having an ink supply roller absorbing ink. The ink supply roller and a ribbon feed drive roller are in contact with each other and thereby allow ink to be transferred to a ribbon feed surface of the ribbon feed drive roller in response to rotation thereof. The ink supply roller moves very slowly and approaches the ribbon feed drive roller in proportion to the rotation of the ribbon feed drive roller by the action of gears and a cam, for thereby allowing the ink supply roller to be depressed gradually by a high pressure. Thus, the ink absorbed in the ink supply roller is gradually squeezed and transferred to the ribbon drive roller. The ink attached to the surface of the ribbon drive roller is transferred to an ink ribbon when the ink ribbon is held between the ribbon drive roller and a ribbon feed driven roller and fed thereby. Hence, the life cycle of the ink ribbon is lengthened. Further, Koshida et al disclose the ribbon feed drive roller comprising a plurality of rollers having the same diameter and integrally fixed to the same shaft at appropriate intervals, and the ribbon feed driven roller comprising rollers the same as those of the ribbon feed drive roller and integrally fixed to another shaft at a location opposite to the feed drive roller. The ribbon is held between the ribbon feed drive roller and the ribbon feed driven roller and is fed therebetween. The ink ribbon of Koshida et al cannot be accurately fed or delivered due to slippage between the ribbon feed drive roller or the ribbon feed driven roller and the ink ribbon upon an increased load. The ink transferred to the ink ribbon is squeezed when a contact pressure sufficient to accurately supply the ink ribbon is applied to the ribbon feed drive roller and the ribbon feed driven roller, even if the load is increased. The squeezed ink overflows to ribbon portions not held between the rollers, thus decreasing the amount of ink to be supplied to the ribbon portion which is held between the rollers. Accordingly, the printing quality is deteriorated since the printing is effected by use of ink which is supplied non-uniformly and since the density of printing is different at various portions of the ribbon.

SUMMARY OF THE INVENTION

It is an object of the present invention to provide an ink ribbon cassette in which the life cycle of the ink ribbon is lengthened.

Another object of the present invention is to provide an ink ribbon cassette in which the ink ribbon is accurately delivered.

Still another object of the present invention is to provide an ink ribbon cassette in which the ink is uniformly supplied to the ribbon and the density of printing is uniform.

Still a further object of the present invention is to provide an ink ribbon cassette having a valley or bottom portion in the shape of a circular arc defined between an idle gear and a drive gear and to which ink is supplied from an ink tank or an ink roller so that the ink retained at the valley portion will be entirely consumed.

Still a further object of the present invention is to provide an ink ribbon cassette including a tooth shape having a tip portion and a valley or bottom portion defined between an idle gear or a drive gear in which the ink is transferred to the ink ribbon without remaining on the teeth.

An ink ribbon cassette according to the present invention has an ink supply source comprising an ink tank or an ink supply roller.

The ink supply source such as the ink tank or the ink roller is in contact with an idle gear or a drive gear to which the ink is supplied. If desired, it is possible to provide a roller or a gear exclusively for use in supplying the ink to the ink ribbon without supplying the ink to the idle gear or the drive gear.

The ink ribbon is held between the idle gear (or drive gear) and the drive gear (or idle gear) and delivered to an ink ribbon container in the body of the ink ribbon cassette.

Most of the ink supplied to the idle gear or the drive gear from the ink tank or ink supply roller is transferred to the ink ribbon each time the ink ribbon is passed between the idle gear and the drive gear. Accordingly, there does not occur the problem that the ink remains unused in the teeth of the idle gear or the drive gear to which the ink is supplied.

Further, the ink ribbon is not damaged by the gears, thereby obtaining an ink ribbon cassette having a long life cycle.

DETAILED DESCRIPTION OF THE PREFERRED EMBODIMENTS

Figure 1:
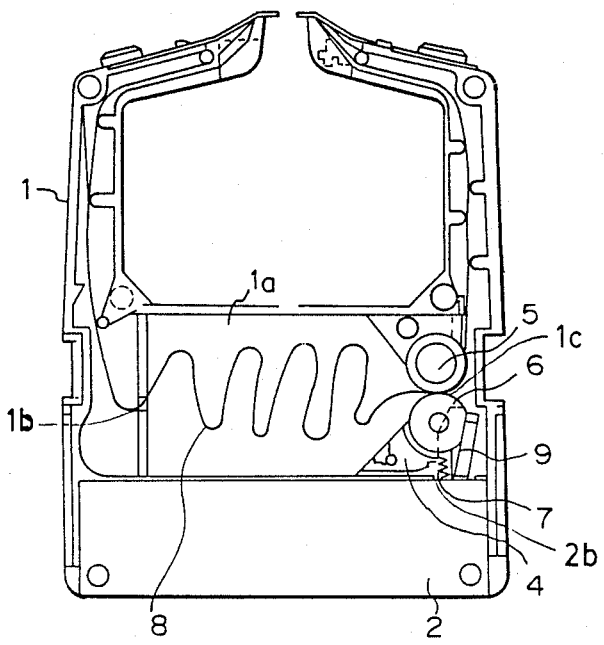
FIG. 1 is a plan view of an ink ribbon cassette shown with a cover thereof removed and having an ink tank according to a first embodiment of the present invention.

An ink ribbon cassette body 1 has an ink tank 2 as shown in FIG. 1. An opening 2*b* is provided in the ink tank 2 and an ink supplier 9 is provided in the vicinity of the opening 2*b*. The ink supplier 9 may be made of a material capable of absorbing ink, such as felt or sponge. An ink ribbon container 1*a* is provided in the vicinity of the middle portion of the ink ribbon cassette body 1. An endless ink ribbon 8 stored in the ink ribbon container 1*a* is delivered through an opening 1*b* in one end of the ink ribbon container 1*a* past a print head of a wire dot printer (not shown) and then into an opening 1*c* in the other end of container 1*a*. An idle gear 6 is provided in container 1*a* adjacent the opening 1*c* through which is fed the ribbon 8 and is biased by a spring 7 into engagement with a drive gear 5. The ink ribbon 8 is delivered to the container 1*a* via a gap between the drive gear 5 and the idle gear 6. The ink ribbon 8 is immersed with ink, but the ink in the ink ribbon 8 is gradually decreased when used to print a paper by the print head of the wire dot printer (not shown). Ink is resupplied to the ink ribbon 8 each time it is delivered between the drive gear 5 and the idle gear 6. Ink tank 2 is filled with a large quantity of ink, and ink in the ink tank 2 is supplied therefrom by the ink supplier 9 to the ink ribbon 8 via the idle gear 6.

A feature of the present invention resides in the shape of the teeth of the drive gear 5 and the idle gear 6, but before describing such feature of the present invention, an ink ribbon cassette of another embodiment will be described.

Figure 2:
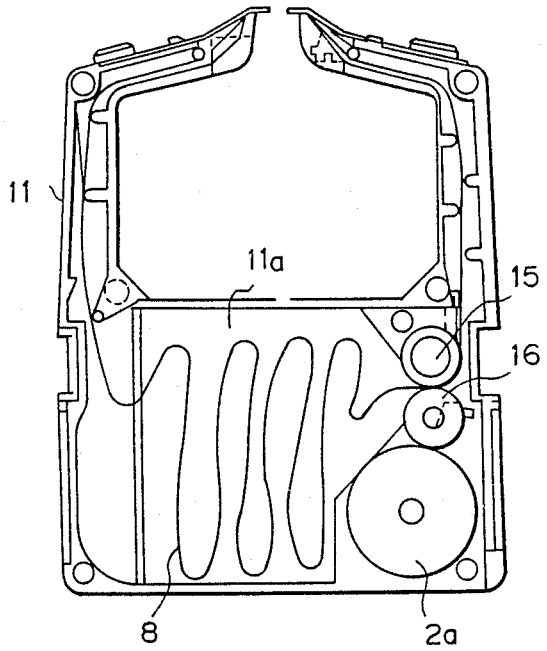
FIG. 2 is a plan view similar to FIG. 1 and having an ink supply roller according to a second embodiment of the present invention.

An ink ribbon cassette body 11 as shown in FIG. 2 has an ink supply roller 2*a* rather than the ink tank 2 and ink supplier 9 shown in FIG. 1. The ink supply roller 2*a* is made of a material capable of absorbing ink, such as felt or sponge. An ink ribbon 8 passes between a drive gear 15 and an idle gear 16 and thereafter is delivered to the inside of an ink container 11*a* which is the same as that shown in FIG. 1. The ink supply roller 2*a* is at all times in contact with the idle gear 16 and is rotatable. The ink supply roller 2*a* is integrally mounted on the body 11 of the ink ribbon cassette. Ink within the ink supply roller 2*a* is passed to the idle gear 16 and then is resupplied to the ink ribbon 8.

Figure 3:
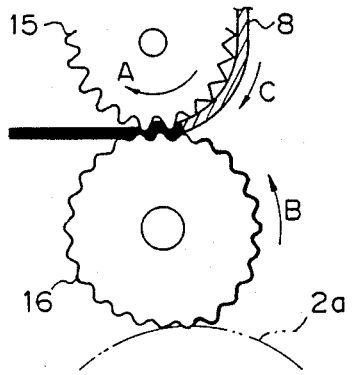
FIG. 3 is a schematic view illustrating an area where ink is transferred to an ink ribbon.

FIG. 3 shows the area whereat the ink is transferred to the ink ribbon 8 in the embodiment of FIG. 2 of the present invention.

When the drive gear 15 is rotated in the direction of an arrow A, the idle gear 16 is rotated in the direction of an arrow B. The ink ribbon 8 is delivered in the direction of an arrow C between the drive gear 15 and the idle gear 16. The idle gear 16 is in contact with the ink supply roller 2*a* for thereby receiving the ink from the ink supply roller 2*a* and delivering the ink in the direction of the arrow B. The ink delivered to the area where the drive gear 15 and the idle gear 16 are meshed with each other is supplied to the ink ribbon 8. That portion of ribbon 8 shown by slanted lines in FIG. 3 require re-inking, and that portion of ribbon 8 shown by solid black shading portion indicates that re-inking has been achieved.

The feature of the present invention resides in a specific shape of teeth of the idle gear 6, 16 and the drive gear 5, 15. That is, each tooth of the idle gear 6, 16 is formed to meet the shape of the ink ribbon 8 which is held between the drive gear 5, 15 and the idle gear 6, 16. The shape of the teeth is determined in the following way.

Figure 4:
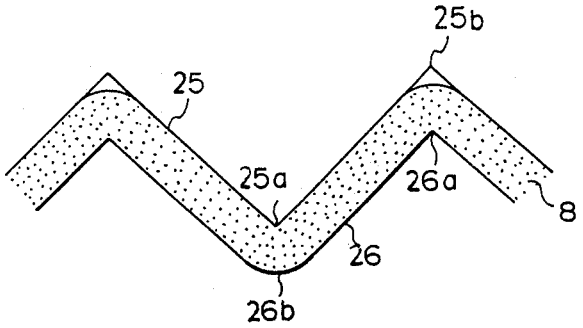
FIG. 4 is a schematic view showing an embodiment of the present invention.

When a tip 25*a* of a tooth of a drive gear 25 is pointed, a circular arc having a radius slightly less than the thickness of the ink ribbon 8 is generated around the tip 25*a*, so that an opposed bottom 26*b* of a tooth of an idle gear 26 is a portion of such circular arc. 26*a* in FIG. 4 is a tip portion of a tooth of the idle gear 26, and 25*b* is an opposed bottom of a tooth of drive gear 25.

Figure 5:
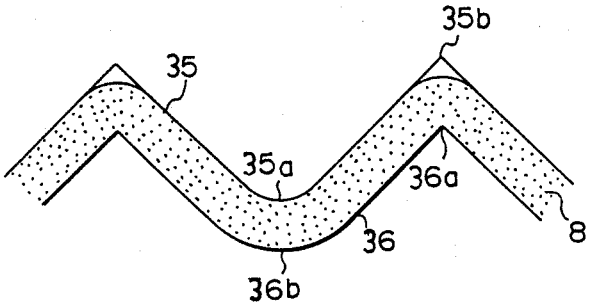
FIG. 5 is a schematic view showing another embodiment of the present invention.

When ink is supplied by a idle gear 36 in another embodiment of the present invention shown in FIG. 5, the tip 35*a* of a tooth of drive gear 35 is a portion of a circular arc about a center axis and having a first radius, and the opposed bottom 36*b* of a tooth of idle gear 36 is a portion of a circular arc about such center axis and having a second radius equal to the sum of the first radius plus a value slightly less than the thickness of the ink ribbon 8. Tip portion 36*a* and opposed bottom 35*b* correspond to elements 26*a*, 25*b*, respectively, of FIG. 4. Thus, damage to the ink ribbon 8 caused by the teeth of the gears 35, 36 is lessened.

Figure 6:
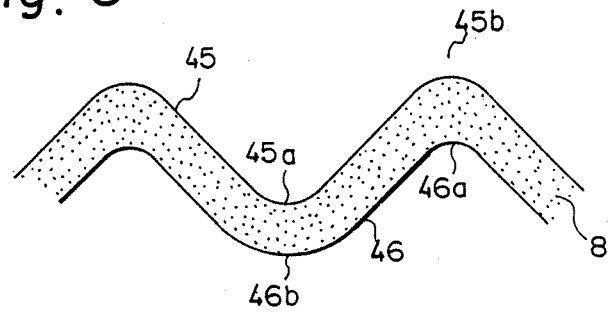
FIG. 6 is a schematic view showing still another embodiment of the present invention.

According to still another embodiment of the present invention as shown in FIG. 6, the tip 45*a* and the bottom 45*b* of the teeth of drive gear 45 and the bottom 46*b* and the tip 46*a* of the teeth of idle gear 46 are all shaped as circular arcs in the manner discussed above regarding FIG. 5, so that damage to the ink ribbon 8 caused by the teeth of the gears is further lessened.

As mentioned above with regard to each of the embodiments, the ink supplied from the ink supply to the idle gear is transferred to the portion of the ink ribbon 8 held between the drive gear and the idle gear while the ink ribbon 8 is held in contact with all portions of the teeth of the idle gear under an appropriate pressure, so that the ink is entirely transferred from the idle gear teeth to the ink ribbon 8. According to the present invention, the ink is not retained at the bottom of the idle gear teeth and is uniformly transferred to the ink ribbon 8.

Although the ink supply roller 2*a* is described as the ink supply means in FIG. 3, the ink tank 2 and the ink supplier 9 of FIG. 1 may be employed as the ink supply means.

What is claimed is:

1. In an ink ribbon cassette including a cassette body, an endless ink ribbon, gear means in said cassette body for moving said ink ribbon through said cassette body, said gear means comprising a drive gear and an idle gear having meshing teeth nipping therebetween said ink ribbon, said teeth of said idle gear having tips and bottoms meshing with respective bottoms and tips of said teeth of said drive gear, and ink supply means in said cassette body and in contact with said idle gear for feeding ink to said teeth thereof, whereby said ink then is applied to said ink ribbon during nipping thereof between said idle and drive gears, the improvement of means for ensuring the uniform application of said ink from said teeth of said idle gear to said ink ribbon, said ensuring means comprising:

said tip of each said tooth of said idle gear being pointed; and said bottom of each said tooth of said idle gear being a portion of a circular arc centered about said tip of the respective meshing tooth of said drive gear, said circular arc having a radius slightly less than the thickness of said ink ribbon.

2. The improvement claimed in claim 1, wherein said ink supply means comprises an ink tank and an ink supplier.

3. The improvement claimed in claim 1, wherein said ink supply means comprises an ink roller.

4. In an ink ribbon cassette including a cassette body, an endless ink ribbon, gear means in said cassette body for moving said ink ribbon through said cassette body, said gear means comprising a drive gear an idle gear having meshing teeth nipping therebetween said ink ribbon, said teeth of said idle gear having tips and bottoms meshing with respective bottoms and tips of said teeth of said drive gear, and ink supply means in said cassette body and in contact with said idle gear for feeding ink to said teeth thereof, whereby said ink then is applied to said ink ribbon during nipping thereof between said idle and drive gears, the improvement of means for ensuring the uniform application of said ink from said teeth of said idle gear to said ink ribbon, said ensuring means comprising:

said tip of each said tooth of said drive gear being a portion of a first circular arc centered about a first center axis and having a first radius; and said bottom of each said tooth of said idle gear being a portion of a second circular arc centered about said first center axis and having a second radius equal to the sum of said first radius plus a value slightly less than the thickness of said ink ribbon.

5. The improvement claimed in claim 4, wherein said ink supply means comprises an ink tank and an ink supplier.

6. The improvement claimed in claim 4, wherein said ink supply means comprises an ink roller.

7. The improvement claimed in claim 4, wherein said tip of each said tooth of said idle gear is a portion of a third circular arc centered about a second center axis and having a third radius, and said bottom of each said tooth of said drive gear is a portion of a fourth circular arc centered about said second center axis and having a fourth radius equal to the sum of said third radius plus a value slightly less than the thickness of said ink ribbon.

8. The improvement claimed in claim 7, wherein said ink supply means comprises an ink tank and an ink supplier.

9. The improvement claimed in claim 7, wherein said ink supply means comprises an ink roller.

* * * * *